US005321758A

United States Patent [19]

Charpentier et al.

[11] Patent Number: 5,321,758

[45] Date of Patent: Jun. 14, 1994

[54] POWER EFFICIENT HEARING AID

[75] Inventors: Albert J. Charpentier, Malvern; Duane J. Loeper, Phoenxville; Brian J. McLaughlin, Brookhaven; Edouard A. Gauthier; David W. DiOrio, both of West Chester, all of Pa.

[73] Assignee: Ensoniq Corporation, Malvern, Pa.

[21] Appl. No.: 134,495

[22] Filed: Oct. 8, 1993

Related U.S. Application Data

[60] Continuation of Ser. No. 832,020, Feb. 6, 1992, which is a division of Ser. No. 318,039, Mar. 2, 1989, Pat. No. 5,111,506.

[51] Int. Cl.[5] ..... H04R 25/00

[52] U.S. Cl. ..... 381/68.2; 381/94; 330/297

[58] Field of Search ..... 381/67, 68, 68.1, 68.2, 381/68.4, 94, 83, 93, 120; 330/202, 297

[56] References Cited

U.S. PATENT DOCUMENTS

| | | | |
|---|---|---|---|
| 4,543,453 | 9/1985 | Brander | 381/68.4 |
| 4,602,337 | 7/1986 | Cox | 381/83 |
| 4,622,440 | 11/1986 | Slavin | 381/68.2 |
| 4,630,304 | 12/1986 | Borth et al. | 381/94 |
| 4,689,819 | 8/1987 | Killion | 381/68.4 |
| 4,759,071 | 7/1988 | Heide | 381/68.4 |
| 4,783,819 | 11/1988 | De Koning et al. | 381/83 |
| 4,852,175 | 7/1989 | Kates | 381/68.4 |
| 4,935,952 | 6/1990 | Dutra | 381/58 |
| 5,046,102 | 9/1991 | Zwicker et al. | 381/68.4 |
| 5,083,312 | 1/1992 | Newton et al. | 381/68.4 |

FOREIGN PATENT DOCUMENTS

| | | | |
|---|---|---|---|
| 59-72851 | 4/1984 | Japan | 381/94 |

*Primary Examiner*—Forester W. Isen
*Attorney, Agent, or Firm*—Ratner & Prestia

[57] ABSTRACT

A power efficient hearing aid uses a programmable biasing technique to set the quiescent operating points of amplifiers used by the hearing aid to avoid excessive power usage by the hearing aid. The hearing aid also includes power supply circuitry which develops +1.25 volts and −1.25 volts relative to ground from a single +1.25 volt source. The hearing aid also conserves power by selectively disabling low frequency signal processing channels in the presence of relatively large amplitude ambient noise.

3 Claims, 9 Drawing Sheets

100
AMB. SOUND COMP.
15
13
COMP. AMP.
12
10
AMP
14
82
BAT
VDD
VDD
VDD
POWER SUPPLY
80
712
710
714
VSS(-1.25)
90
EXT PROG UNIT
DIGITAL INTERFACE
92
EEPROM
94
BIAS SYSTEM
96
5
5
VBH
VBL
95
82
SW
29
30
31
32
33
16
BPF 1 OCT 178Hz
17
BPF 1/2 OCT 338Hz
18
BPF 1/2 OCT 588Hz
19
BPF 1/2 OCT 776Hz
20
BPF 1/2 OCT 1.04KHz
21
BPF 1/3 OCT 1.44KHz
22
BPF 1/2 OCT 1.8KHz
23
BPF 1/3 OCT 2.3KHz
24
BPF 1/3 OCT 2.9KHz
25
BPF 1/3 OCT 3.6KHz
26
BPF 1/3 OCT 4.6KHz
27
BPF 1/3 OCT 5.8KHz
28
BPF 1/3 OCT 7.2KHz 40
41
42
43
44
45
46
47
48
49
50
51
52
ATT
60
SUM AND S&H
71
VOL.
70
AMP.
VBL
VDD
FINAL AMP
72
76
74A
SW
RA
74B
RB
74C
RC
74D
74
78
4
1

BIAS SYSTEM 96

AMBIENT SOUND COMPENSATOR

POWER EFFICIENT HEARING AID

This application is a continuation of application Ser. No. 07/832,020 filed Feb. 6, 1992.

This application is a division of application Ser. No. 07/318,039, filed Mar. 2, 1989, now U.S. Pat. No. 5,111,506.

TECHNICAL FIELD

The present invention relates generally to hearing aids and in particular to a multi-featured hearing aid designed to make efficient use of its power source.

BACKGROUND ART

In the design of hearing aids, there is inherently a tradeoff between the functionality of the device on the one hand and its size and power requirements on the other hand. For example, it is known to include several signal processing channels in the design of a hearing aid, each channel separately processing a distinct band of audio frequencies. A device of this type can provide more flexible performance and, thus a better perceived performance among a group of users, having diverse hearing problems, than a device which amplifies all frequencies as a single band. In addition, the perceived performance among the group of users increases in direct proportion to the number of channels that are used, up to some limiting number. However, each channel that is added to a hearing aid increases the size of the device and its power consumption. Consequently, few hearing aids exist which use multiple frequency channels and those which do, use only a few channels.

In recent years, there has been a widespread use of linear very large scale integration (VLSI) in the design of hearing aids. These circuits allow a designer to increase the functionality of a hearing aid without significantly increasing its size. But this increase in functionality may be at the expense of an undesirable increase power consumption. VLSI devices have increased power consumption relative to smaller scale devices because they include a larger number of components. Moreover, one type of component, the amplifier, is often designed with a complex biasing network to overcome variations in performance that are attributable to variations in the processes used to produce the amplifiers. These biasing networks may trade inefficiencies in the use of the power source for consistent device performance.

The power requirements of a hearing aid are an important design parameter. Because hearing aid batteries are relatively expensive it is desirable for the hearing aid to use them efficiently. In addition, since the battery is one of the larger components of a hearing aid, it is desirable to design circuitry which uses few batteries as possible.

DESCRIPTION OF THE INVENTION

The present invention is embodied in a hearing aid which includes an integrated circuit designed for efficient power usage. The integrated circuit includes a multiple channel network which processes respective multiple signals, each representing a distinct audio frequency band. Each channel in the network includes at least one amplifier circuit. To reduce power usage, each of the amplifier circuits is coupled to programmable biasing circuitry by which the current applied to the amplifier may be adjusted to compensate for deficiencies in the operating characteristics of the amplifier circuits caused by variations in the processes used to manufacture the integrated circuit.

According to a further aspect of the invention, selected channels in the multi-channel network are disabled in environmental conditions that may cause a relatively high current flow through the amplifiers that constitute the selected channels.

According to another aspect of the invention, the hearing aid includes a power supply which uses a switched-capacitor network to produce, from a battery power source, a range of voltages greater than the range of voltages available from the battery power source itself.

DETAILED DESCRIPTION OF THE FIGURES

Figure 1:
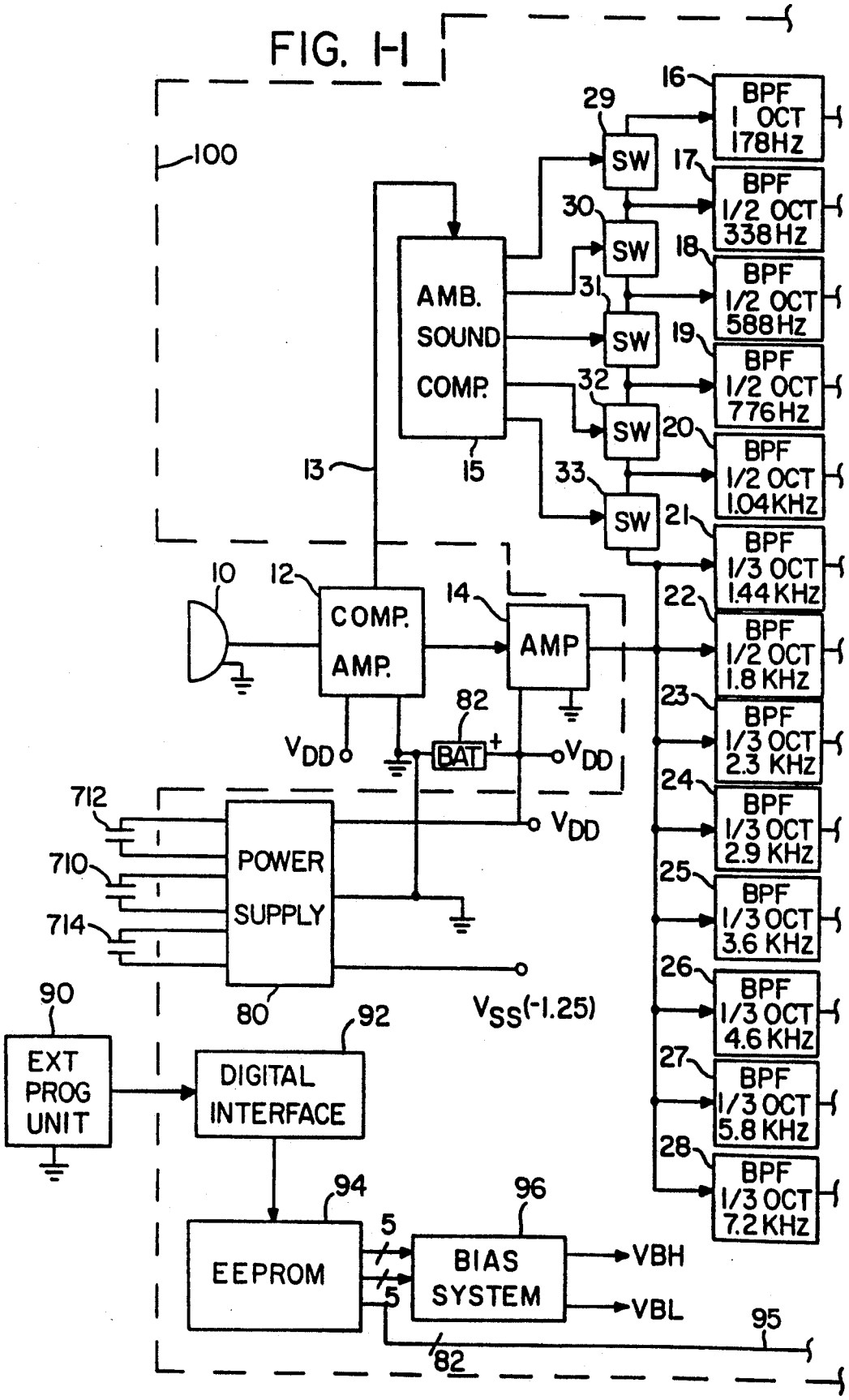
FIG. 1 is a block diagram of hearing aid circuitry which includes an embodiment of the invention.

FIG. 1 is a block diagram of an exemplary hearing aid which includes an embodiment of the present invention. This hearing aid includes thirteen distinct signal processing channels which process signals in thirteen respective frequency bands. Each channel includes a band-pass filter and an programmable attenuator. The programmable attenuators may be adjusted using digital interface circuitry so that the hearing aid may be configured to compensate for a wide variety of hearing deficiencies. In addition, the five lowest frequency channels may be completely disabled in the presence of relatively high levels of ambient noise, both to save power by not processing this noise and to increase the intelligibility of words spoken over the ambient noise.

The hearing aid shown in FIG. 1 includes a VLSI integrated circuit (IC) 100 which uses the power-efficient complementary metal oxide semiconductor (CMOS) technology. Further power efficiency is gained by using a programmable biasing technique for the amplifiers in the IC 100 and by using switched-capacitor designs for the band-pass filters and programmable attenuators. The hearing aid also includes an efficient power supply which uses switched capacitor techniques to develop operating potentials of +1.25 volts and −1.25 volts from a single battery that, itself, provides only +1.25 volts.

In the description set forth below, the circuitry used in this hearing aid is described first in general terms of its function and then in greater detail, emphasizing its power efficiency.

In FIG. 1, sound waves are converted to electrical signals by a microphone 10, which applies the electrical signals to a compression amplifier 12. The amplifier 12 amplifies relatively quiet sounds and attenuates relatively loud sounds so that the power output of the amplifier remains substantially within a predetermined dynamic range. The circuitry 12 amplifies signals in a frequency range from 100 Hz to 10 KHz. The output signals of the compressor amplifier 12 are applied to a further amplifier 14 which drives the 13 signal processing channels. The amplifiers 12 and 14 used in this embodiment of the invention provide a net amplification factor of 56 dB. These amplifiers are available as a single integrated circuit, the LD-512 manufactured by Gennum Corp.

As set forth above, each of the 13 signal processing channels includes a band pass filter and a programmable attenuator. The band-pass filters used in the respective signal processing channels are numbered 16 through 28 and their corresponding attenuators are numbered 40 through 52. The band-pass filters used in this embodiment of the invention are of conventional design. As shown in FIG. 1, the band pass filter 16 has a one octave passband, the filters 17 and 18 have one-half octave passbands and the filters 20 through 28 have one-third octave passbands. The center frequencies for the filters 16 through 28 are 178 Hz, 338 Hz, 588 Hz, 776 Hz, 1.04 KHz, 1.44 KHz, 1.8 KHz, 2.3 KHz, 2.9 KHz, 3.6 KHz, 4.6 KHz, 5.8 KHz, and 7.2 KHz. The transition regions of the frequency response characteristics of these exemplary filters exhibit a roll-off of approximately 12 dB/octave. Circuitry suitable for use as one of these switched-capacitor band-pass filters is disclosed in U.S. Pat. No. 4,622,440 entitled "Differential Hearing Aid With Programmable Frequency Response" which is hereby incorporated by reference.

Each of the thirteen band-pass filters passes signals in a respectively different band of frequencies. However, there may be some overlap in the bands of frequencies passed by successive filters. Each of the attenuators 40 through 52 is separately programmable via an external programming unit 90, a digital interface 92 and an electronically erasable programmable read-only memory (EEPROM) 94 to provide up to 40 dB of attenuation to the signals applied to their respective input terminals. An exemplary attenuator is described below in reference to FIG. 6.

The output signals provided by the attenuators 40 through 52 are applied to summing and sample-and-hold circuitry 60. The circuitry 60 adds together all of the signals provided by the attenuators and samples the summed signal to remove any sampling artifacts introduced by the switched capacitor band-pass filters 16 through 28 and attenuators 40 through 52.

The output signal of the circuitry 60 is applied to an amplifier 70. The amplifier 70 is responsive to a volume control 71 to allow the user to adjust the level of sound produced by the hearing aid. This amplifier provides an amplification factor between 0 dB and 40 dB. The signals produced by the amplifier 70 are applied to a final amplifier 72 which provides an amplification factor of 10 dB. In this embodiment of the invention, the final amplifier 72 is not a part of the IC 100. The output signals of the final amplifier 72 are applied to a final attenuator 74 which is a part of the IC 100.

The final attenuator 74 includes three resistors, RA, RB and RC and four switches, 74A, 74B, 74C and 74D. Each of these switches is controlled by a separate bit provided by the EEPROM 94. When the switch 74D is closed, the output of the final amplifier 72 is coupled directly to the receiver 76, so there is no attenuation. If the switch 74D is open and any of the other switches are closed, a resistance is inserted in the path between the final amplifier 72 and a receiver 76. The amount of attenuation provided by any combination of resistors depends on the relative impedances of the combined resistors and the receiver. The final attenuator 74 provides between 0 and 40 dB of attenuation. The amount of attenuation provided is adjustable via the external programming unit 90, digital interface 92 and EEPROM 94. The output signal of the final attenuator 74 drives the receiver 76 which produces sound waves in the ear of the user.

An output signal 13 of the compressor amplifier 12, which indicates the sound pressure level at the microphone 10, is applied to an ambient sound compensation circuit 15. The circuit 15 detects ambient sound levels having amplitudes in a predetermined range. Responsive to these detected levels, the circuit 15 selectively disables up to five of the lower frequency channels of the hearing aid circuitry using switches 39 through 33. This step successively disables the low frequency channels in the presence of high levels of ambient noise, both to save power and to increase the intelligibility of speech. Power is saved since the input signals to the band-pass filters and attenuators for the low frequency channels are disabled when high levels of signal are present. The intelligibility of speech is increased because the low frequency bands, which generally contain a large portion of the ambient noise, are de-emphasized relative to higher frequency bands which contain a relatively large portion of the speech information.

Figures 1, 2:
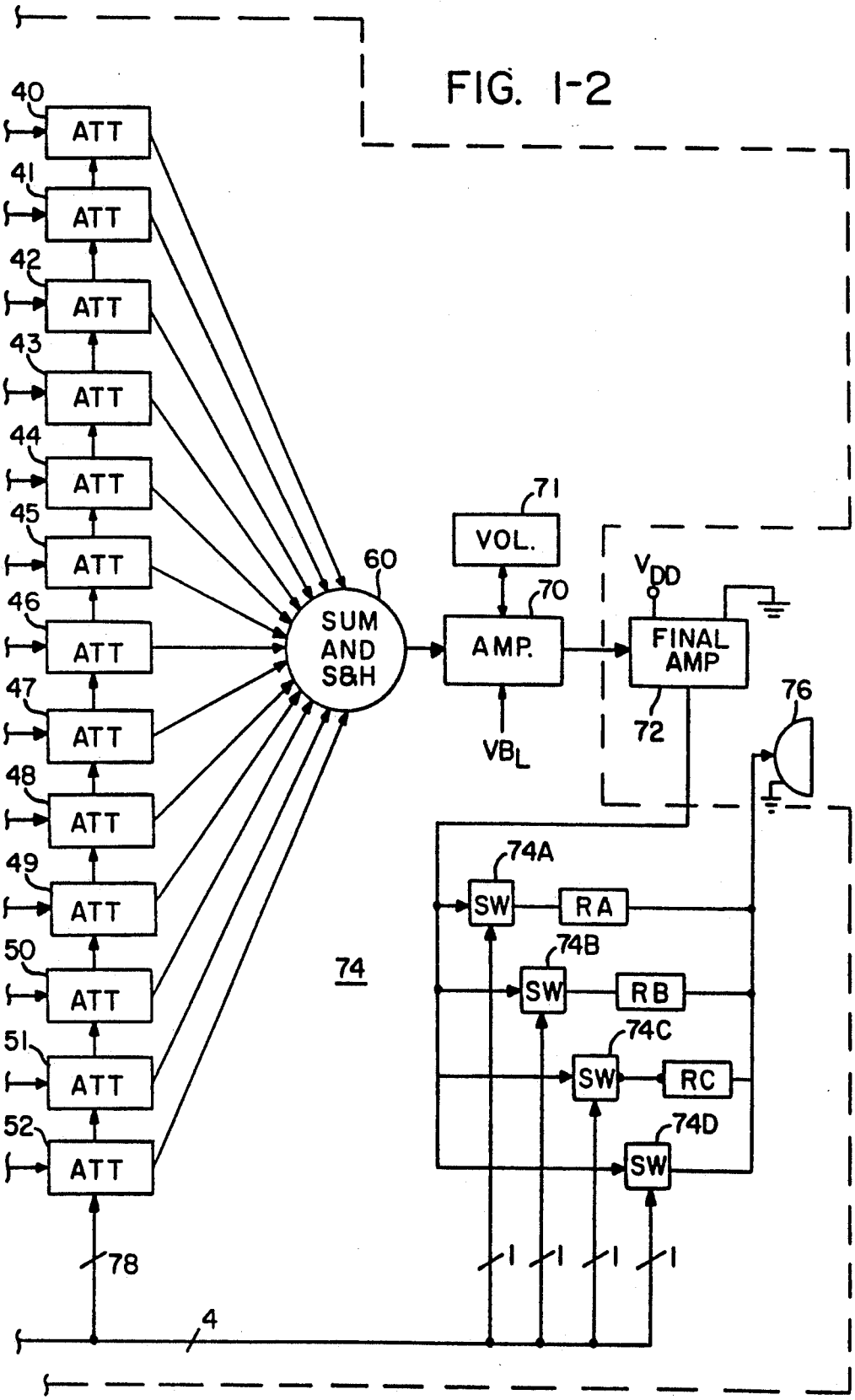
FIGS. 2 and 3 are schematic diagrams of exemplary operational amplifiers suitable for use in the band-pass filters and attenuators of the circuitry shown in FIG. 1.
Figure 2:
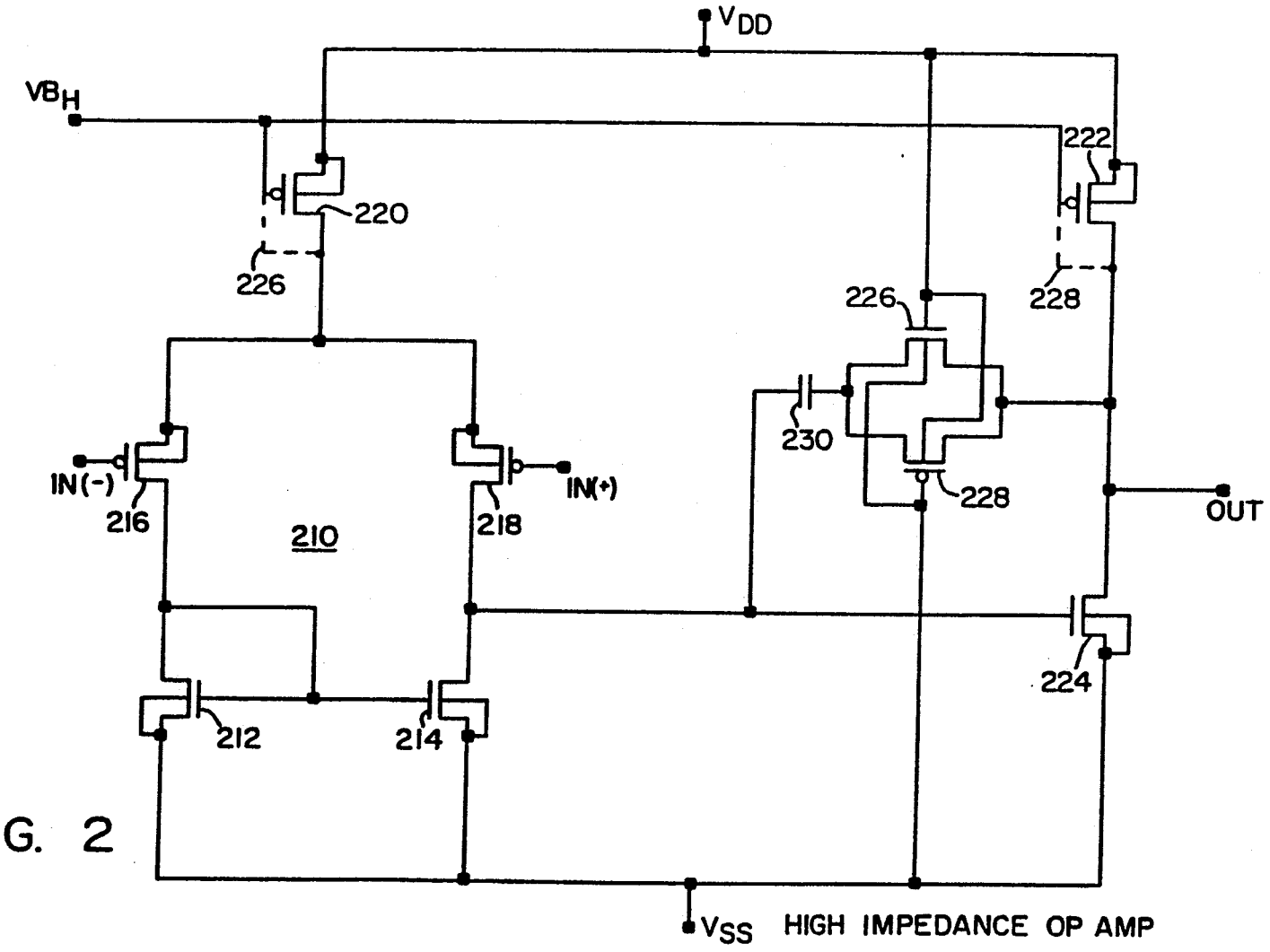
Figure 3:
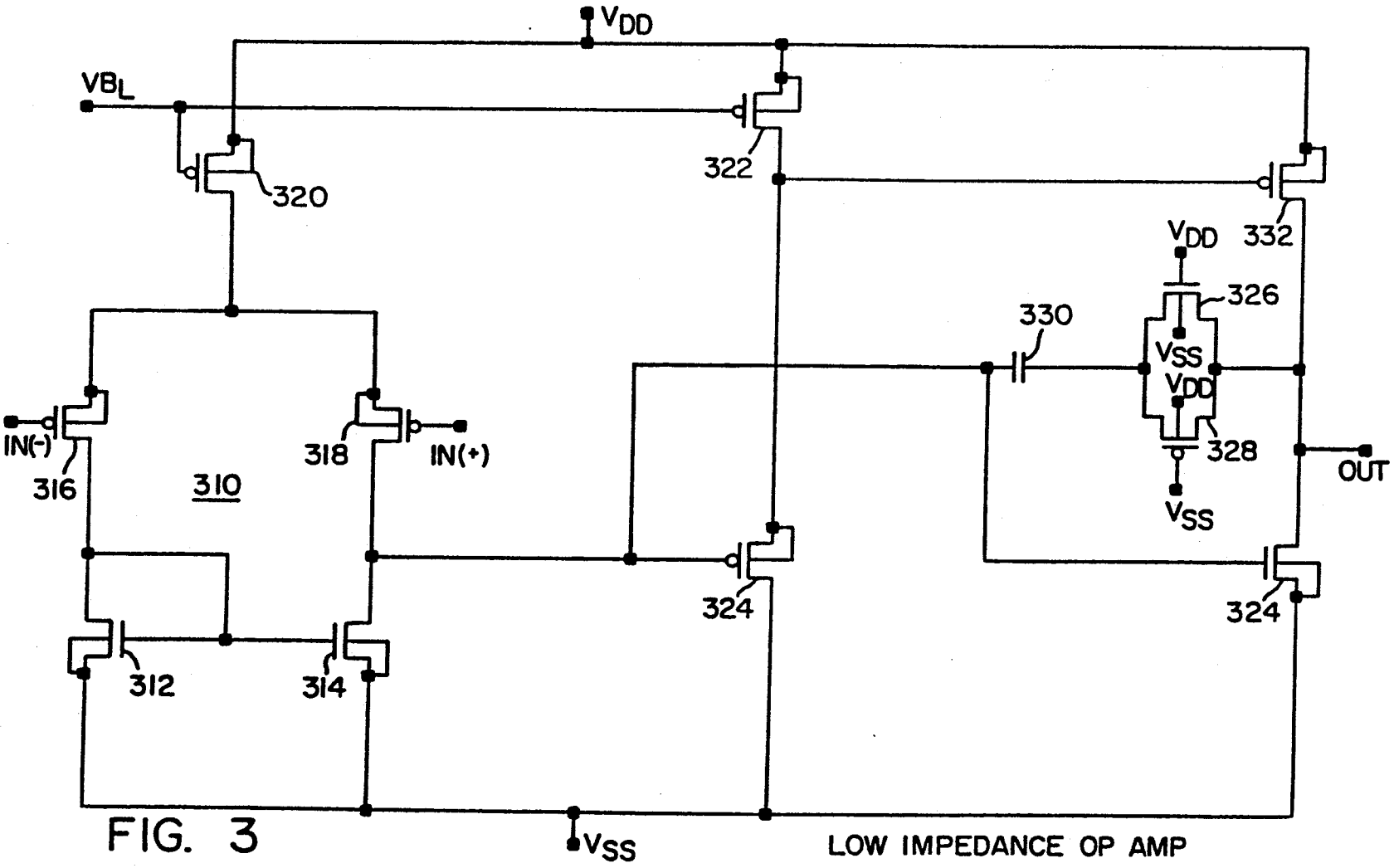

The integrated circuit 100, illustrated by the broken-line box in FIG. 1, includes many CMOS operational amplifier circuits. Each band-pass filter and each attenuator includes at least one of these circuits. Exemplary operational amplifier circuits are illustrated in FIGS. 2 and 3. The circuit shown in FIG. 2 is conventional except for the biasing transistors 220 and 222. The circuit includes a differential amplifier 210, which drives an output transistor 224. A feedback network, formed by the transistors 226 and 228 and the capacitor 230, is included to ensure that the amplifier does not become unstable.

The operational amplifier shown in FIG. 3 is similar to the one shown in FIG. 2 except that it includes a push-pull output stage formed by the transistors 322 and 324. This output stage is provided to enable the amplifier to drive a relatively low impedance load. In the present embodiment of the invention, only the amplifier 70 shown in FIG. 1 is configured to drive a low impedance load. All of the amplifiers in the band-pass filters 16 through 28 and in the attenuators 40 through 52 are configured to drive a high impedance load. It is contemplated all of the operational amplifiers used in the IC 100 may be low impedance amplifiers of the type shown in FIG. 3.

As set forth above, the configuration of the biasing transistors 220 and 222 of FIG. 2 and of the biasing transistors 320 and 322 of FIG. 3 is unconventional. Referring to FIG. 2, the gate terminals of the transistors 220 and 222 in a conventional operational amplifier would not be coupled to the biasing potential $VB_h$ but would, instead, be connected to their respective drain terminals as illustrated by the broken-line connections 226 and 228, respectively. In this conventional configuration, these transistors would act as resistors, providing a controlled current to the remainder of the operational amplifier circuitry. However, due to variations in the processes used to manufacture the IC 100, the biasing transistors 226 and 228 could, if they were connected in this manner, provide more current than is needed to the respective differential amplifier 210 and output transistor 224.

Since the IC 100 includes many operational amplifiers having substantially the same power requirements, the conventional biasing technique may cause significant differences in power efficiency from one IC to the next. To make the IC's more uniform, this embodiment of the invention includes a programmable biasing technique. According to this technique, after the hearing aid is assembled and tested, the gate potential applied to the biasing transistors 220 and 222, or 320 and 322 of each operational amplifier in the IC 100 may be adjusted to achieve optimal performance.

The adjustment is accomplished through the external programming unit 90, digital interface 92, EEPROM 94 and bias system 96 shown in FIG. 1. The digital interface 92 used in this embodiment of the invention includes a 106 bit serial-in, parallel-out register (not shown) which holds all of the programmable values. When a hearing aid device is reconfigured, the external programming unit 90 inserts the value to be changed into its proper position in a local 106 bit register. This register is then sent to the digital interface 92 and loaded into the internal register. When there are no more programming changes to be made, the external programming unit 90 issues a command which conditions the digital interface 92 to store the contents of the internal 106-bit register into a parallel 106-bit EEPROM 94. During normal operation, the values held in the EEPROM control the programmable functions.

To set the optimal bias level for a particular IC 100, a digital value representing a nominal bias level is applied to the digital interface 92 by the external programming unit 90. With an ammeter coupled in series with the battery, or some other suitable power source, the current drawn by the device under quiescent conditions is determined. If this current is outside of a predetermined optimal range, the external programming unit 90 is used to increase or decrease the value applied to the digital interface 92, which, as described below, conditions the bias system 96 to respectively increase or decrease the amount of current drawn by the device. When a current flow within the optimal range is achieved, the value applied to the digital interface 92 is permanently stored in the EEPROM 94. The steps outlined above are done twice; once for the operational amplifiers, illustrated in FIG. 2, which drive a high-impedance load, and once for the operational amplifiers, illustrated in FIG. 3, which drive a low-impedance load.

Figure 4:
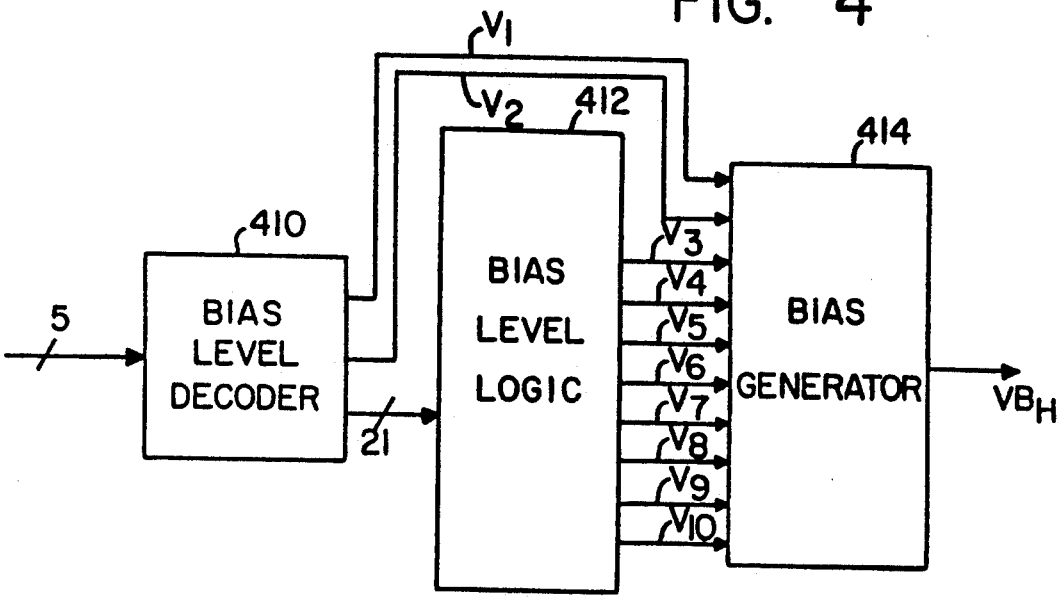
FIG. 4 is a block diagram showing details of a programmable biasing circuit suitable for use in the hearing aid circuitry shown in FIG. 1.

FIG. 4 is a block diagram of circuitry suitable for use as part of the bias system 96. The circuitry shown in FIG. 4 develops the bias voltage $BV_h$ which is used to bias the operational amplifiers similar to the one shown in FIG. 2. The circuitry which generates the signal $BV_l$ for the operational amplifiers illustrated by FIG. 3 may be identical to the circuitry shown in FIG. 4. In FIG. 4, a five-bit digital value is applied to a bias level decoder 410 which converts the signal into 23 signals. Two of these signals, $V_1$ and $V_2$ are applied directly to a bias generator 414 and the other 21 signals are applied to bias level logic circuitry 412 which develops eight more signals that are applied to the bias generator circuit 414. The bias generator 414 uses these ten signals to develop the bias voltage $BV_h$.

In the present embodiment of the invention, the bias level decoder 410 and the bias level logic 412 are implemented as a programmable logic array. To simplify the description of these devices, the 23 output signals, $V_1$, $V_2$ and M0 through M20, of the bias level decoder 410 are described, in a table 1, in terms of five input signals, A, B, C, D and E representing the five-bit value provided by the digital interface 92 and EEPROM 94. Similarly, the eight output signals of the bias level logic circuitry, $V_3$ through $V_{10}$ are described in terms of the signals M0 through M20 in a table 2. The signal A is the most significant bit (MSB) of five-bit signal provided by the digital interface 92 via the EEPROM 96 and the signal E is the least significant bit (LSB).

TABLE 1

| Output Signal | Input Combination |
|---|---|
| $V_1$ | $\overline{DE}$ |
| $V_2$ | $D\overline{E}$ |
| M0 | $A\overline{B}\overline{C}DE$ |
| M1 | $A\overline{B}\overline{C}D$ |
| M2 | $B\overline{C}\overline{E}$ |
| M3 | $A\overline{C}\overline{E}$ |
| M4 | $\overline{A}\overline{B}\overline{C}DE$ |
| M5 | $\overline{A}\overline{B}C$ |
| M6 | $\overline{A}BC$ |
| M7 | $\overline{A}C\overline{E}$ |
| M8 | $\overline{B}CDE$ |
| M9 | $\overline{B}\overline{C}DE$ |
| M10 | BCDE |
| M11 | $A\overline{B}\overline{C}\overline{E}$ |
| M12 | $AB\overline{C}\overline{D}E$ |
| M13 | $\overline{C}\overline{D}E$ |
| M14 | $A\overline{B}\overline{D}E$ |
| M15 | $AB\overline{C}\overline{D}$ |
| M16 | $B\overline{C}\overline{D}E$ |
| M17 | $A\overline{B}DE$ |
| M18 | $\overline{A}\overline{B}CDE$ |
| M19 | ABDE |
| M20 | CDE |

TABLE 2

| Output Signal | Input Combination |
|---|---|
| $V_3$ | $(\overline{M8 + M13})$ |
| $V_4$ | $(\overline{M4 + M9 + M16})$ |
| $V_5$ | $(\overline{M19 + M20})$ |
| $V_6$ | $(\overline{M6 + M11 + M14 + M18})$ |
| $V_7$ | $(\overline{M0 + M1 + M2 + M5 + M7 + M9})$ |
| $V_8$ | $(\overline{M3 + M8 + M10})$ |
| $V_9$ | $(\overline{M0 + M1 + M4 + M7 + M12 + M15 + M17})$ |
| $V_{10}$ | $(\overline{M2 + M3 + M4 + M8 + M10})$ |

The encoding set forth above was chosen to map the 32 different values of the five bit signal provided by the external programming unit into 31 approximately equal voltage steps for each of the biasing potentials $VB_h$ and $VB_l$ provided by the bias generator 214.

Figure 5A:
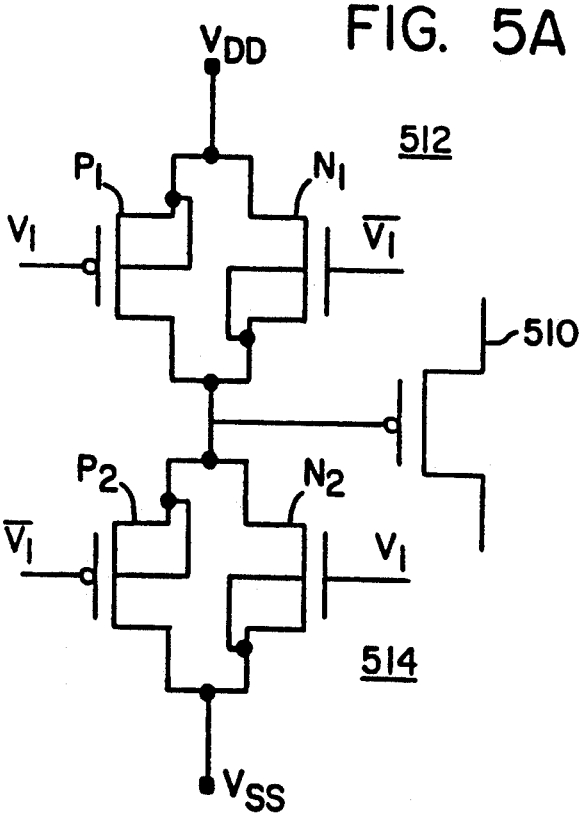
FIG. 5A is a schematic diagram of switching circuitry suitable for use in the circuitry shown in FIG. 5.
Figure 5:
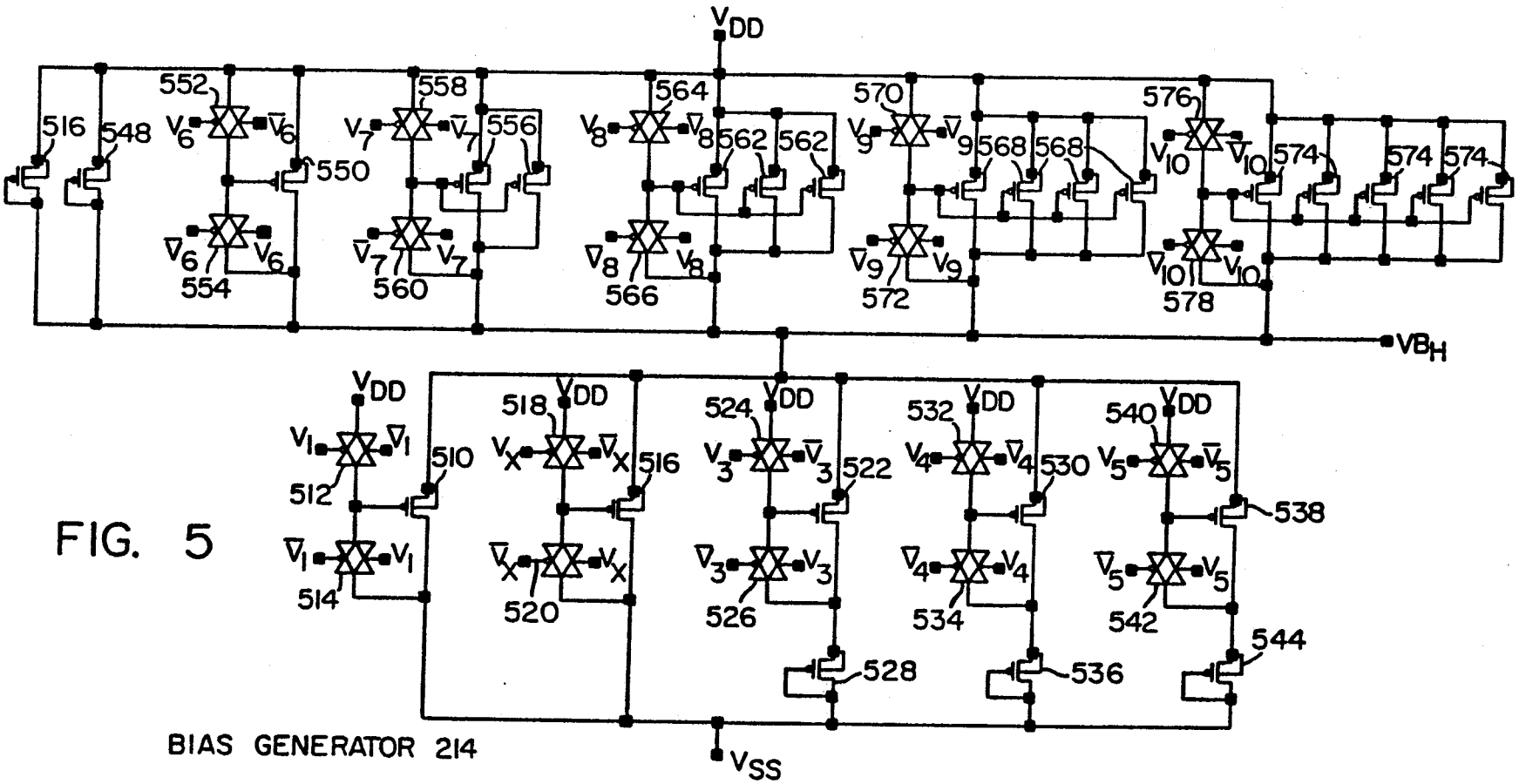
FIG. 5 is a schematic diagram of bias generation circuitry suitable for use in the programmable biasing circuit shown in FIG. 4.

FIG. 5 is a schematic diagram of the bias generator 214. The circuitry shown in FIG. 5 is a programmable voltage divider. The voltage divider consists of an lower circuit controlled by the signals $V_1$ through $V_5$ and an upper circuit controlled by the signals $V_6$ through $V_{10}$. In this embodiment of the invention, the lower circuit implements relatively large steps in the value of the bias voltage $VB_h$ and the upper circuit implements relatively small steps. Both the upper and lower circuits include five switchable sub-circuits. In addition, the upper circuit includes two fixed sub-circuits. The two fixed sub-circuits are the transistors 546 and 548. These transistors each have their respective gate electrodes connected to their drain electrodes. As set forth above, in reference to FIG. 2, in this configuration, the transistors 546 and 548 appear as parallel resistors.

All of the other sub-circuits are switchable; they may either appear as a resistor or as an open circuit. An exemplary switchable sub-circuit is the one controlled by the signal $V_1$. This sub-circuit includes a transistor 510 and switches 512 and 513. The switches 512 and 513 couple the gate of the transistor 510 either to a first source of operating potential, $V_{DD}$ or to a second source of operating potential $V_{SS}$. The switches are controlled in a complementary manner by the signal $V_1$ and its logical complement $V_1'$ so that only one switch is open at any given time. When the switch 512 is closed and the switch 514 is open, the gate of the transistor 510 is coupled to the source $V_{DD}$ and the transistor 510 is essentially an open circuit. When the switch 512 is open and the switch 514 is closed, the gate and drain electrodes of the transistor 510 are connected and the transistor 510 is configured as a resistor.

The switches 512 and 514 are shown in greater detail in FIG. 5A. In FIG. 5A, the switch 512 includes a P-channel enhancement mode MOS transistor, P1, and an N-channel enhancement mode MOS transistor, N1. The gate electrode of the transistor P1 is coupled to receive the control signal $V_1$ and the gate electrode of the transistor N1 is coupled to receive the signal $V_1$, the logical complement of the signal $V_1$. The switch 515 includes P-channel and N-channel enhancement mode MOS transistors P2 and N2, where the gate electrodes of the transistors P2 and N2 are coupled to receive the control signals $V_1$ and $V_1$, respectively. In the present embodiment of the invention, the control signals $V_1$ through $V_{10}$ may have two possible values, $V_{DD}$, corresponding to logic-one and $V_{SS}$ corresponding to logic-zero. Thus, when the signal $V_1$ has is logic-one, both of the transistors P2 and N2 are turned on, coupling the gate electrode of the transistor 510 to the source $V_{SS}$, and both of the transistors P1 and N1 are turned off. When $V_1$ is logic-zero, the transistors P1 and N1 are turned on and the transistors P2 and N2 are turned off.

Each of the switched sub-circuits has this same basic structure. In the lower circuit of the bias generator 214, transistors 510, 516, 522, 530 and 538 are switched responsive to the respective control signals $V_1$, $V_2$, $V_3$, $V_4$ and $V_5$. In addition, the transistors 522, 530 and 538 are each coupled in series with respective transistors 528, 536 and 544. Each of the transistors 528, 536 and 544 has its gate electrode connected to its drain electrode and, thus acts as a resistor in series with the switchable resistor formed by the respective transistors 522, 530 and 538. The transistors in the lower circuit are designed with principal conduction paths having different widths and different lengths and thus have respectively different resistance values when they are switched into the circuit. In the present embodiment of the invention, the resistance of the transistor 510 is the lowest, followed by the resistance of the transistor 516, and then the pairs of transistors 522, 528; 530, 536 and 538, 544. The actual ratios used depend on the materials and processes used to produce the devices. One skilled in the art of integrated circuit design can determine suitable length-to-width ratios without undue experimentation.

The upper circuit has a similar structure to the lower circuit, however, in the upper circuit, differing numbers of identical transistors are configured in parallel to achieve different resistance values. In the upper circuit, the single transistor 550 is switched by the signal $V_6$, two parallel transistors 556 are switched by the signal $V_7$, three parallel transistors 562 are switched by the signal $V_8$, four parallel transistors 568 are switched by the signal $V_9$, and five parallel transistors 574 are switched by the signal $V_{10}$. In terms of the conduction channel dimensions set forth in the table 3, each of the transistors in the upper circuit of the bias generator 214 has a width/length ratio of 5/10.

As set forth above, the lower circuit is used to produce relatively large changes in the value of $VB_h$, and the upper circuit is used to produce relatively small changes. The particular configuration of gates shown in FIG. 5 and the decoding and encoding schemes represented by the tables 1 and 2 allow the biasing potentials, $VB_h$ and $VB_l$, to be adjusted in relatively small steps, in response to successive values of the five-bit signal provided by the external programming unit 90.

As set forth above, the external programming unit 90, digital interface 92 and EEPROM 94 may also be used to set the frequency response characteristic of the hearing aid by setting an attenuation level in each of the thirteen signal processing channels. To set an attenuation level, the external programming unit 90 first inserts a six-bit value, representing the gain of a particular channel, into the proper location in a copy of the register used by the digital interface 92, and then sends the modified copy to the digital interface 92. From the digital interface 92, the attenuation factor is applied to its respective attenuator via a bus 95.

Figure 6:
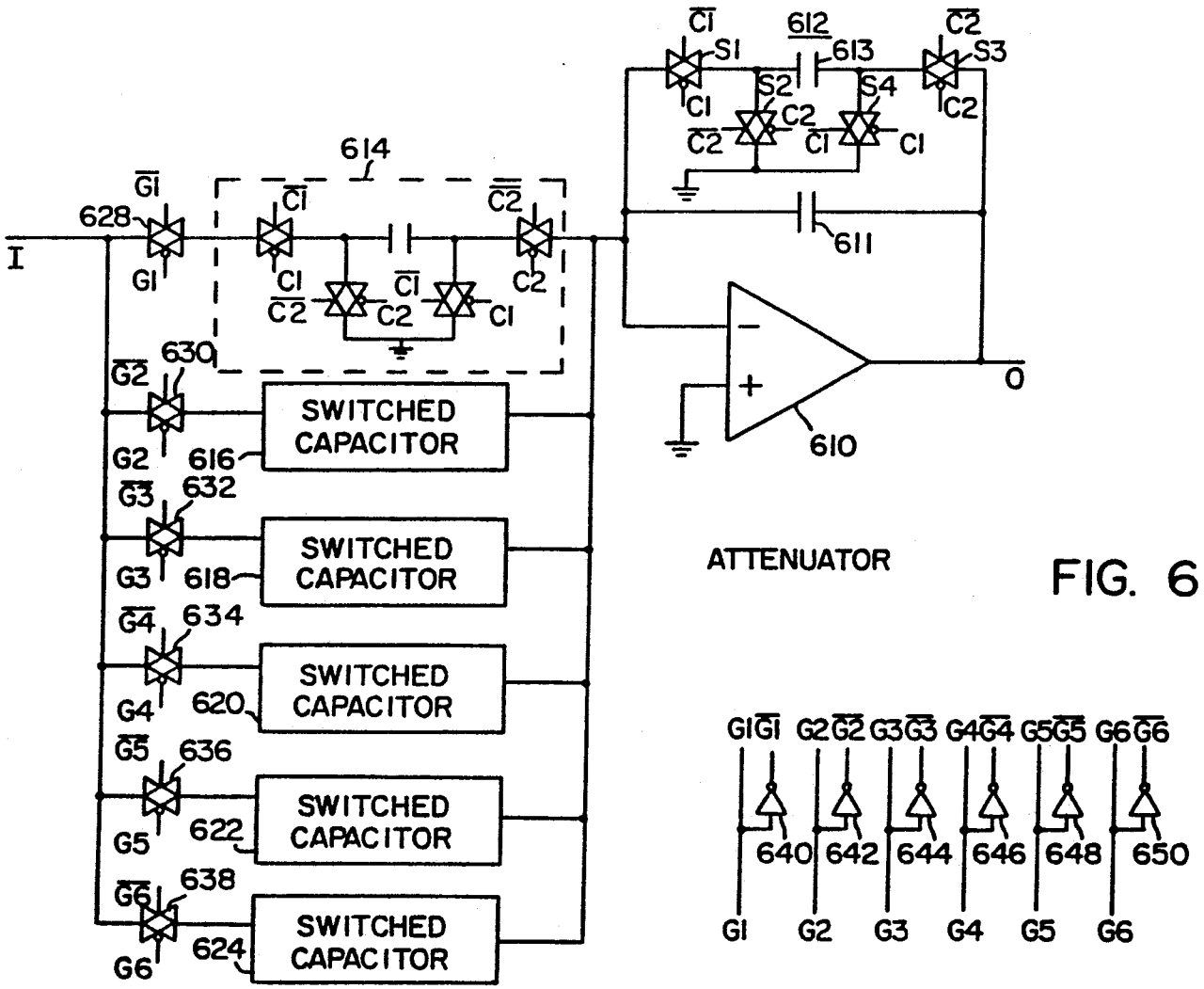
FIG. 6 is a schematic diagram, partially in block diagram form of an attenuator suitable for use in the circuitry shown in FIG. 1.

FIG. 6 is a schematic diagram, partially in block diagram form, of an exemplary attenuator. This attenuator includes an operational amplifier 610 having a fixed capacitor 611 and a switched capacitor network 612 in a feedback loop from the output terminal, O, of the operational amplifier 610 to its inverting input terminal. In addition the attenuator includes six switched capacitor networks, 614, 616, 618, 620, 622 and 624 which are coupled between an input terminal, I, of the attenuator and the noninverting input terminal of the operational amplifier 610. Each of the switched capacitor networks 614, 616, 618, 620, 622 and 624 includes a switch in its input path. These switches, 628, 630, 632, 634, 636 and 638 are controlled by signals G1, G2, G3, G4, G5 and G6, respectively, to selectively apply input signals provided via the input terminal I, through their respective switched capacitor networks, to the noninverting input terminal of the operational amplifier 610.

The six signals G1 through G6 are the six-bit attenuation control signal provided by the digital interface 92. These signals are inverted by the respective inverters 640, 642, 644, 646, 648 and 650 to provide both inverted and noninverted versions of the signals to control the respective gates 628, 630, 632, 634, 636 and 638. Each of these gates and each gate in each of the switched capacitor networks may be, for example, identical to the gate circuit described above in reference to FIG. 5A.

The switched capacitor networks 612, 614, 616, 618, 620, 622 and 624 are each responsive to two antiphasal clock signals, C1 and C2. These clock signals may have a frequency of, for example, 100 KHz and a duty cycle of slightly less than 50%. Except for the value of their capacitances, all of the switched capacitor networks are identical. The description of the structure and operation of the network 612, set forth below applies to the networks 614, 616, 618, 620, 622 and 624, which, for the sake of brevity, are not described in detail.

The switched capacitor network 612, includes four switches, S1, S2, S3 and S4 which alternately couple a capacitor 613 between the output terminal O and a source of reference potential (e.g. ground) on the one hand and the inverting input terminal of the operational amplifier 610 and ground on the other hand. The clock signal C1, which controls the switches S1 and S4, is antiphasal to the signal C2 which controls the switches S2 and S3, so, when the switches S1 and S4 are open, the switches S2 and S3 are closed and vice versa.

In a first time interval, when the switches S2 and S3 are closed, terminal A of the capacitor 613 is coupled to ground and terminal B is coupled to the output terminal O of the operational amplifier 610. During this time interval, the current provided by the amplifier 610 charges the capacitor 613 to a potential which depends on the amount of current provided by the amplifier 610. At the end of the first time interval, the switches S2 and S3 are opened and the switches S1 and S4 are closed coupling terminal A of the capacitor 613 to the inverting input of the amplifier 610 and terminal B to ground for a second time interval. In this configuration, the capacitor 613 is coupled to apply the inverse of the potential developed during the previous time interval to the inverting input of the amplifier 610. This potential is summed with potentials provided by the switched capacitor networks 614, 616, 618, 620, 622 and 624 to provide an input potential to the amplifier 610.

The fixed capacitor 611 configured in parallel with the switched capacitor network 612 acts to stabilize the amplifier 610 and to remove any high frequency artifacts of the switched capacitor processing. This capacitor conditions the circuitry shown in FIG. 6 to operate as a low-pass filter having a cut-off frequency that is above the highest audio frequency processed by the hearing aid but below the sampling frequency of the switched capacitor networks, that is to say, below the frequency of the clock signals C1 and C2. Thus, artifacts of the switched capacitor processing are rejected by the attenuator circuitry shown in FIG. 6.

It is well known that switched capacitor networks such as 612, 614, 616, 618, 620, 622 and 624 may be modeled as resistors in analyzing the performance of the circuit. The value of the capacitor in a network is inversely proportional to the equivalent resistance value for the network. If each of the switched capacitor networks in the circuitry shown in FIG. 6 were replaced by its equivalent resistance, the circuitry would be configured as a conventional class A amplifier, the gain of the amplifier being determined by the ratio of the feedback resistance to the input resistance.

In the circuitry shown in FIG. 6, the values of the capacitors in the switched capacitor networks are chosen such that the gain of the amplifier is always fractional and so, the circuitry shown in FIG. 6 always attenuates signals applied to its input terminal. The capacitors are selected such that the network 614 provides 20 dB of attenuation, and the networks 616, 618, 620, 622 and 624 divide up an additional 20 dB of attenuation into 0.625 dB steps. Thus the attenuator shown in FIG. 6 may be programmed to provide signal attenuation of between approximately 0.5 dB and 40 dB.

As set forth above, the operational amplifiers in each of the attenuators 40 through 52 and in each of the band-pass filters 16–28 use operating potentials of +1.25 volts ($V_{DD}$) and −1.25 volts ($V_{SS}$). As shown in FIG. 1, these operating potentials are developed from a single +1.25 volt source, battery 82, by a power supply 80.

Figure 7:
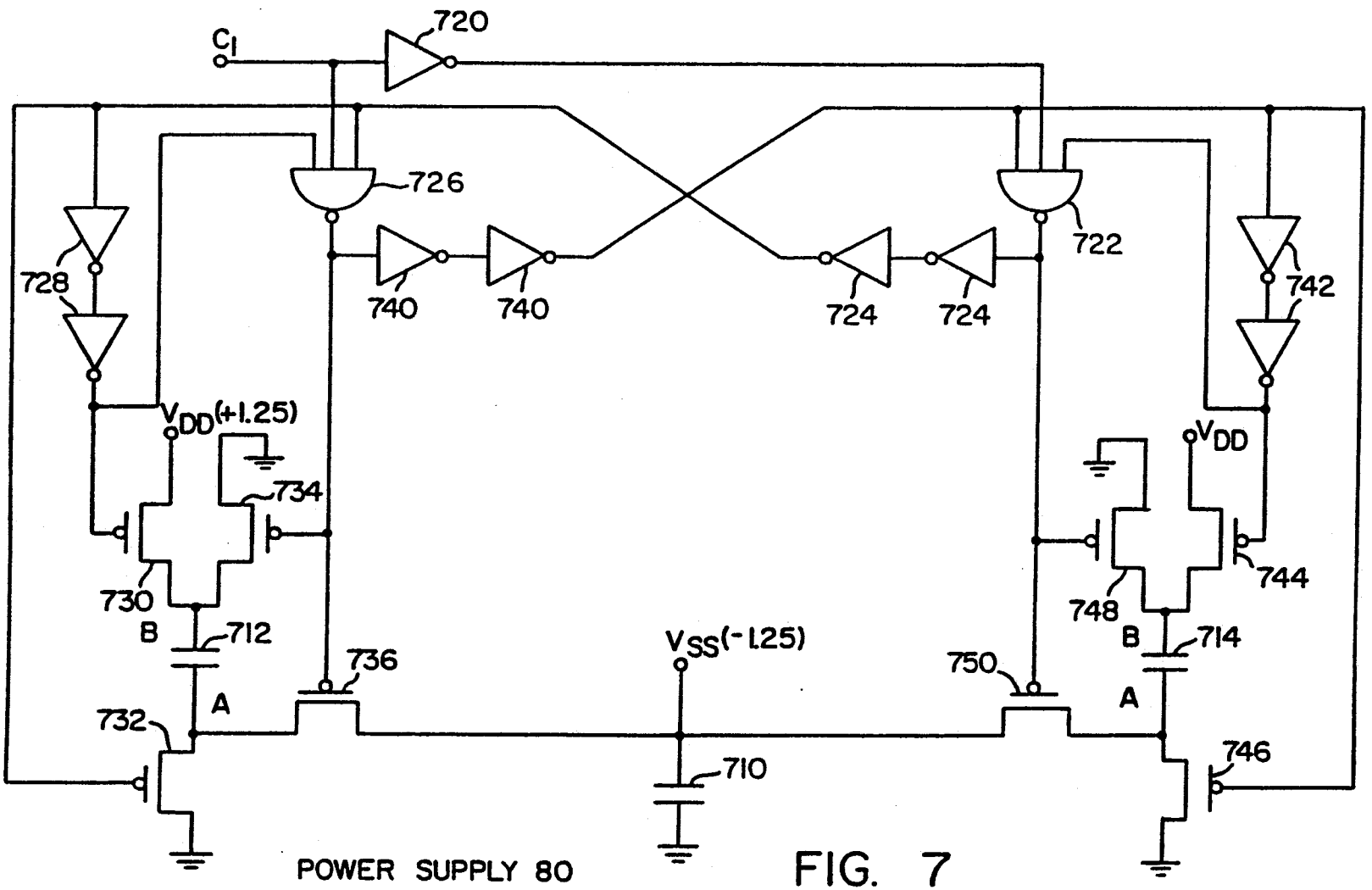
FIG. 7 is a schematic diagram of power supply circuitry suitable for use in the circuitry shown in FIG. 1.

FIG. 7 is a block diagram, partially in schematic diagram form, of circuitry suitable for use as the power supply 80. All components except for the capacitors 710, 712 and 714 are contained in the IC 100. These three capacitors, which may, for example, have capacitance values of 0.1 microfarad, are separate from the IC 100. In overview, this power supply circuitry uses the positive and negative terminals of the battery 82 as $V_{DD}$ and ground, respectively, and, using switched capacitor techniques, charges a capacitor 710 to have a potential of −1.25 volts relative to ground to establish $V_{SS}$. The capacitor 710 is charged by the capacitors 712 and 714. The capacitors 712 and 714 are alternately charged to +1.25 volts relative to ground and then alternately switched in polarity to provide the −1.25 volt potential to the capacitor 710. While the capacitor 712 is charging, the capacitor 714 is coupled to the capacitor 710 and while the capacitor 714 is charging, the capacitor 712 is coupled to the capacitor 710. The operation of the switching circuitry is described in greater detail below.

To simplify the description of the circuitry shown in FIG. 7, it is assumed that the logic-one state is positive with respect to ground and that the logic-zero state is at or near ground potential. The logic-one and logic-zero states are is referred to as "high" and "low", respectively. All of the transistors shown in FIG. 7 are P-channel enhancement-type MOSFETs.

The clock signal C1 is coupled to a first input terminal of a NAND gate 726 and to an inverter 720. When the clock signal C1 goes high, the output signal of the inverter 720 goes low. This output signal is applied to one input terminal of a NAND gate 722. When the output signal of the inverter 720 goes low, the output signal of the NAND gate 722 goes high. The output signal of the NAND gate 722 is applied to gate input terminals of respective transistors 748 and 750. When the signal provided by the gate 722 goes high, both of the transistors 748 and 750 are turned off, disconnecting a terminal A of the capacitor 714 from the capacitor 710 and a terminal B of the capacitor 714 from ground.

The high output signal of the NAND gate 722 is delayed by the inverter pair 724. The output signal of this inverter pair is applied to an inverter pair 728, to a second input terminal of the NAND gate 726 and to the gate input terminal of a transistor 732. This signal turns off the transistor 732, disconnecting a terminal A of the capacitor 712 from ground. The delayed signal provided by the inverter pair 728 is applied to a third input terminal of the NAND gate 726 and to the gate input terminal of a transistor 730.. This signal turns off the transistor 730, disconnecting a terminal B of the capacitor 712 from the operating potential $V_{DD}$. The three high signals applied to the NAND gate 726 condition it to provide a low output signal. This output signal is applied to the gate input terminals of transistors 734 and 736, and conditions these transistors to turn on. When the transistors 734 and 736 are turned on, the terminals B and A of the capacitor 712 are coupled to ground and to the capacitor 710, respectively. In this configuration, the capacitor 712 is coupled in parallel with the capacitor 710 and has a potential of −1.25 volts with respect to ground.

The output signal of the NAND gate 726 is delayed by an inverter pair 740. The output signal of the inverter pair 740 is applied to a second input terminal of the NAND gate 722, to an inverter pair 742 and to the gate input terminal of a transistor 746. This low signal turns on the transistor 746, coupling the terminal A of the transistor 714 to ground. A delayed low signal, provided by the inverter pair 742 is applied to a third input terminal of the NAND gate 722 and to the gate input terminal of a transistor 744. This signal turns on the transistor 744, coupling the terminal B of the capacitor 714 to $V_{DD}$. In this configuration, the capacitor 714 is in parallel with the battery and develops a potential of +1.25 volts with respect to ground.

When the clock signal C1 goes low, the circuitry shown in FIG. 7 first decouples the capacitor 712 from the capacitor 710, then reverses the polarity of the capacitor 714, coupling it in parallel with the capacitor 710 and finally, couples the capacitor 712 in parallel with the battery 82 to restore it to +1.25 volts. The description of the circuitry performing these functions is essentially a mirror image of the description set forth above. That is to say, the description is the same except that components on the left of FIG. 7 take the place of corresponding components on the right and vice versa.

As set forth above, a key power saving feature of the circuitry shown in FIG. 1 is the ability to disable between one and five of the lower frequency channels in the presence of relatively high levels of ambient sound. This feature is implemented by the ambient sound compensator 15 and the switches 29 through 33.

Figure 8:
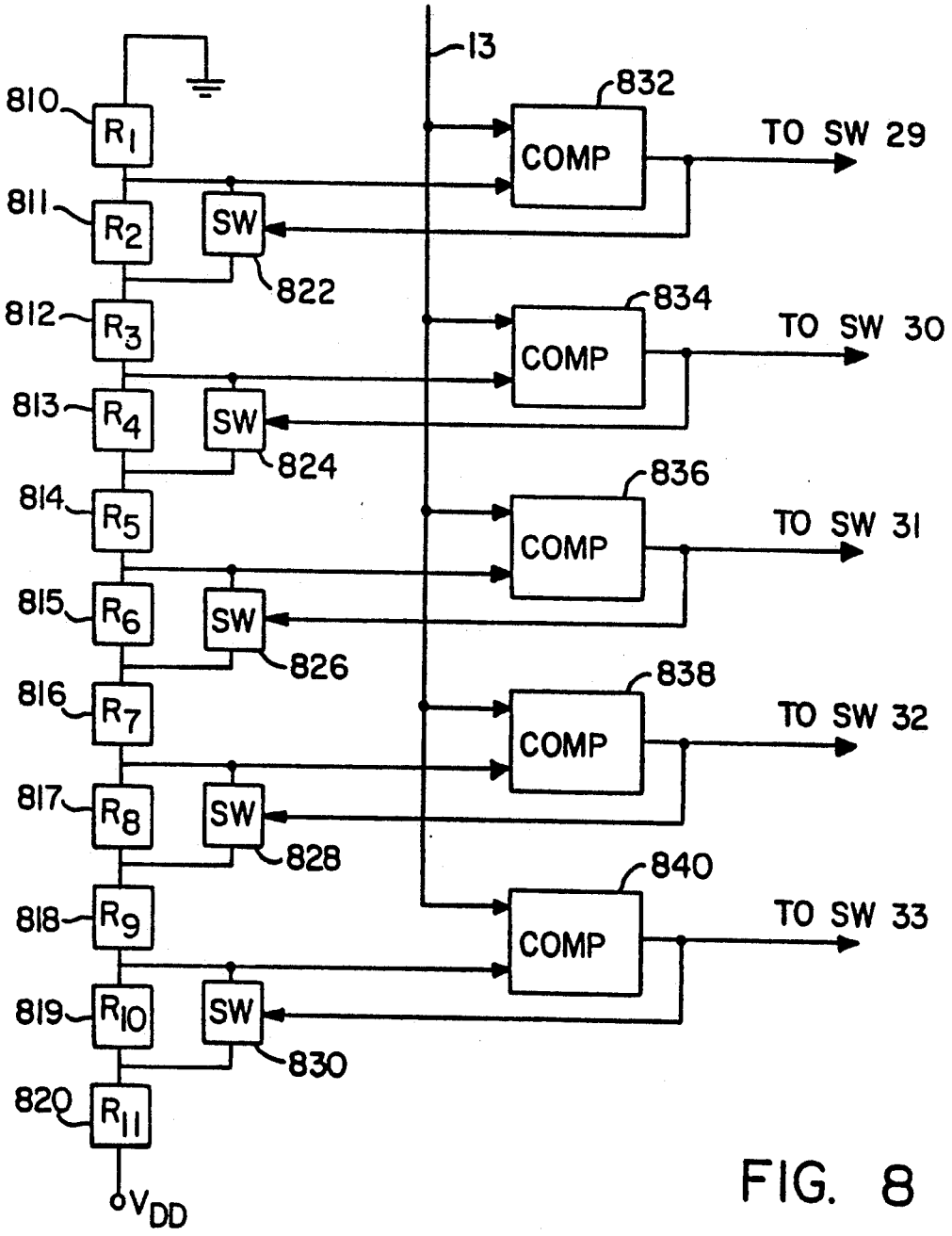
FIG. 8 is a block diagram of ambient sound compensation circuitry suitable for use in the hearing aid circuitry shown in FIG. 1.

FIG. 8 is a block diagram of exemplary circuitry for use as the ambient sound compensator 15. In FIG. 8, the signal 13 provided by the compressor amplifier 12 is coupled to respective first input terminals of comparators 832, 834, 836, 838 and 840. Second input ports of each of the comparators are coupled to receive a reference potential from a voltage divider network. The voltage divider network includes 11 serially-connected resistors, 810 through 820. A terminal of the resistor 810 couples one end of the voltage divider network to the operating potential $V_{DD}$ and a terminal of the resistor 820 couples the other end of the voltage divider network to ground. The comparator 832 takes its reference potential from the junction of the resistors 810 and 811; the comparator 834, from the junction of the resistors 812 and 813; the comparator 836, from the junction of the resistors 814 and 815; the comparator 838, from the junction of the resistors 816 and 817; and the comparator 840, from the junction of the resistors 818 and 819.

All of the comparators 832, 834, 836, 838 and 840 operate in substantially the same manner. Accordingly, only the operation of the comparator 832 is described in detail. When the amplitude of the sound-pressure signal 13 is greater than the reference potential at the junction of the resistors 810 and 811, the output signal of the comparator 832 conditions the switch 29 to open and, simultaneously, conditions a switch 822 to close. When the switch 29 opens, it disconnects the input of the band-pass filter 16 from the output of the amplifier 14, effectively disabling the lowest frequency channel of the hearing aid. When the switch 822 closes, it removes the resistor 811 from the voltage divider network and, so, reduces the reference potential applied to the comparator 832. Thus, the comparator 832 will hold the switch 29 open until the amplitude of the sound pressure signal falls below the lower reference potential.

The switch 822 provides the comparator 832 with hysteresis, which tends to keep the input of the band-pass filter 16 switched off, avoiding annoying repetitive switching that could occur if a fixed threshold were used. The comparators 834, 836, 838 and 840 are coupled to respective switches 824, 826, 828 and 830 which operate in the same manner to provide hysteresis.

While the invention has been described in terms of an exemplary embodiment, it is contemplated that it may be practiced as outlined above with modifications within the spirit and scope of the appended claims.

We claim:

1. In a hearing aid, including a microphone for receiving acoustic energy and for converting said acoustic energy into electrical signals occupying a predetermined band of frequencies, and signal processing means including a plurality of signal processing channels operating in parallel and having respective frequency response characteristics for processing electrical signals in a respective plurality of sub-bands of said predetermined band of frequencies, a method of operating said hearing aid to reduce objectionable externally generated background noise, said method comprising the steps of:

monitoring said electrical signals to change the state of a control signal from a first state to a second state when said electrical signals indicate that the average acoustic energy, including the externally generated background noise, received by said microphone has become greater than a first threshold value;

disabling a first one of said plurality of signal processing channels responsive to said control signal being in said second state to cause the hearing aid to use less power than if the one signal processing channel were enabled while the background noise is present;

changing the state of said control signal from said second state to said first state when the electrical signals indicate that the average acoustic energy received by said microphone has become less than a second threshold value, said second threshold value being less than said first threshold value; and reenabling said one signal processing channel responsive to said control signal undergoing a transition from said second state to said first state.

2. A hearing aid, comprising:

a microphone for receiving acoustic energy including externally generated background noise and for converting said acoustic energy into electrical signals occupying a predetermined band of frequencies;

signal processing means including a plurality of signal processing channels operating in parallel for processing a respective plurality of electrical signals representing acoustic energy in a respective plurality of sub-bands of said predetermined band of frequencies;

monitoring means, responsive to first and second ones of said plurality of electrical signals for generating a control signal which changes from a first state to a second state when the first and second electrical signals indicate that the average acoustic energy received by said microphone has become greater than a first threshold value and which changes from the second state to said first state when the first and second electrical signals indicate that the average acoustic energy received by said microphone has become less than a second threshold value, said second threshold value being less than said first threshold value; and switching means, responsive to said control signal undergoing a transition from said first state to said second state for disabling a first one of said signal processing channels to reduce, in magnitude, signals representing the externally generated background noise and to cause the hearing aid to use less power than if said one signal processing channel were enabled while the background noise is present, and responsive to said control signal undergoing a transition from said second state to said first state for reenabling said first signal processing channel.

3. The hearing aid set forth in claim 2, wherein:

said monitoring means includes means for generating a further control signal which changes from a first state to a second state when the first and second electrical signals indicate that the average acoustic energy received by said microphone is greater than a third threshold value, said third threshold value being greater than said first threshold value; and said switching means includes means for disabling a second one of said plurality of signal processing channels responsive to a transition of said further control signal from said first state to said second state.

* * * * *

UNITED STATES PATENT AND TRADEMARK OFFICE

CERTIFICATE OF CORRECTION

PATENT NO. : 5,321,758

DATED : June 14, 1994

INVENTOR(S) : Charpentier et al.

It is certified that error appears in the above-identified patent and that said Letters Patent is hereby corrected as shown below:

ON THE TITLE PAGE:

Add the following references to Field [56];

| | | |
|---|---|---|
| 4,119,814 | 10/1978 | Harless |
| 4,396,806 | 08/1983 | Anderson |
| 4,425,481 | 01/1984 | Mansfold et al. |
| 4,450,930 | 05/1984 | Killion |
| 4,471,171 | 09/1984 | Kopke et al. |
| 4,484,345 | 11/1984 | Stearns |
| 4,489,610 | 12/1984 | Slavin |
| 4,490,585 | 12/1984 | Tanaka |
| 4,508,940 | 04/1985 | Steeger |
| 4,517,415 | 05/1985 | Laurence |
| 4,548,082 | 10/1985 | Engebretson |
| 4,596,902 | 06/1986 | Gilman |
| 4,680,798 | 07/1987 | Neumann |
| 4,718,099 | 01/1988 | Hotvet |
| 4,731,850 | 03/1988 | Levitt et al. |

UNITED STATES PATENT AND TRADEMARK OFFICE

CERTIFICATE OF CORRECTION

PATENT NO. : 5,321,758

DATED : June 14, 1994

INVENTOR(S) : Charpentier et al.

It is certified that error appears in the above-indentified patent and that said Letters Patent is hereby corrected as shown below:

S. Mangold and A. Leijon, "Programmable Hearing Aid with Multichannel Compression," Scand. Audio., 8:121-126, 1979.

Signed and Sealed this

Twenty-fifth Day of July, 1995

*Attest:*

Bruce Lehman

BRUCE LEHMAN

*Attesting Officer*

*Commissioner of Patents and Trademarks*